United States Patent [19]

Mach et al.

[11] Patent Number: 4,790,957

[45] Date of Patent: Dec. 13, 1988

[54] POLYCARBOXYLIC ACID ESTERS AND LUBRICANTS CONTAINING THESE ESTERS

[75] Inventors: Helmut Mach, Heidelberg; Hans-Henning Vogel, Frankenthal; Juergen Jahn, Dannstadt, all of Fed. Rep. of Germany

[73] Assignee: BASF Aktiengesellschaft, Ludwigshafen am Rhein, Fed. Rep. of Germany

[21] Appl. No.: 106,390

[22] Filed: Oct. 9, 1987

[30] Foreign Application Priority Data

Oct. 18, 1986 [DE] Fed. Rep. of Germany ..... 3635490

[51] Int. Cl.[4] ..... C10M 129/72

[52] U.S. Cl. ..... 252/56 S; 252/57; 560/76; 560/101; 560/190; 560/202

[58] Field of Search ..... 252/56 S, 57; 560/76, 560/101, 190, 202

[56] References Cited

U.S. PATENT DOCUMENTS

| | | | |
|---|---|---|---|
| 3,249,544 | 5/1966 | Hoffman et al. | 252/51.5 A |
| 3,481,873 | 12/1969 | Aylesworth | 252/56 S |
| 3,674,692 | 7/1972 | Göthel et al. | 252/56 S |
| 3,701,730 | 10/1972 | Daniels et al. | 252/56 S |

OTHER PUBLICATIONS

R. C. Garderson et al, Synthetic Lubricants, Reinhold Publishing Co, 1962, pp. 156–157.

*Primary Examiner*—Jacqueline V. Howard
*Attorney, Agent, or Firm*—John C. Demeter

[57] ABSTRACT

This invention relates to aliphatic or aromatic polycarboxylic acid esters as defined herein which are useful as base oils alone in lubricating oil compositions or in admixture with completely synthetic, partially synthetic, or mineral oil-based lubricant compositions.

6 Claims, No Drawings

POLYCARBOXYLIC ACID ESTERS AND LUBRICANTS CONTAINING THESE ESTERS

BACKGROUND OF THE INVENTION

1. Field of the Invention

This invention relates generally to lubricating oil compositions and, miore particularly, to aliphatic or aromatic polycarboxylic acid esters, as defined herein, useful as a base oil alone or in admixture with completely synthetic, partially synthetic, or mineral oil based lubricant compositions.

2. Description of the Relevant Art

Modern lubricant compositions, especially lightweight motor oils, are not composed solely of mineral oil components, but include synthetic components. Particularly, lubricating oils for motor vehicles are faced with increasing demands, since the number of revolutions, working pressures and power output are constantly increasing while at the same time the requirement is for high service life and reliability in the engine.

Heavy-duty oils, to which additives are added for a supplementary function such as aging and corrosion protection, high pressure resistance as well as "a dirt carrier," follow wide range oils with flat viscosity curves and suitability for both summer and winter operation. These heavy-duty oils have an extended oil changing interval and even offer decreased fuel consumption, especially in winter operation and in short distance driving. A flat viscosity curve signifies a decreased dependence of viscosity on temperature of the lubricating oil. A measure for the temperature dependence is the viscosity index (VI).

Using a variety of different esters in synthetic lubricating additives is well known in the state of the art. U.S. Pat. No. 4,130,494, for example, discloses certain amine salts of phosphate esters as additives in synthetic lubricating oil formulations. These additives are said to decrease undesired depositing in motors, especially in turbine engines.

U.S. Pat. No. 4,155,861 discloses a lubricant comprising a mixture of a monomeric ester of a branched dicarboxylic acid with an aliphatic primary monoalcohol and a complex ester of a dicarboxylic acid and hexanediol or trimethyl hexanediol. The monomeric diester is always a mixed diester (column 6, lines 1 and 2), and specifically cited in trimethyladipic acid octyl decyl ester. The lubricant combination described is claimed to be characterized by having a universal application.

The known polycarboxylic acid esters are manufactured, for example, on a large industrial scale while using oxo-alcohols as esterification components. Oxo-alcohols, which are especially suited for esters as synthetic lubricants, are manufactured from oligo olefins.

Table I illustrates common oligo olefins and the alcohols able to be prepared from them through oxo-reactions.

TABLE I

| Oligo Olefin | Oxo-Alcohol |
|---|---|
| Diisobutene | Iso-nonanol |
| Triisobutene | Iso-tridecanol |
| Propene dimer (Isohexene) | Iso-heptanol |
| Propene trimer | Iso-decanol |
| Propene tetramer | Iso-tridecanol |

From these commercially available oxo-alcohols, polycarboxylic acid esters are prepared, which find application as synthetic lubricants. See, for example, R. C. Gunderson and A. W. Hunt, *Synthetic Lubricants, Reinhold Publishing Company,* 1962, page 151 and following; and D. Klamann, *Lubricants and Related Products,* Verlag Chemie, 1984, which are incorporated herein by reference.

An objective of the present invention is polycarboxylic acid esters for use as a base oil alone or in admixture with completely synthetic, partially synthetic, or mineral oil based lubricant compositions which demonstrate an improved temperature/viscosity behavior as expressed by a higher viscosity index and improved low temperature properties and having a lower evaporation loss and higher flash point than known polycarboxylic acid esters.

This objective is surprisingly met by the aliphatic or aromatic polycarboxylic acid esters described in greater detail below.

SUMMARY OF THE INVENTION

The subject of the present invention is a lubricant composition base oil comprising at least one of an aliphatic or aromatic polycarboxylic acid ester having the Formula I:

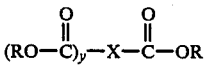

(I)

wherein X is a straight or branched alkylene radical or an arylene radical; R is a radical afforded by the oxidation of an n-butene-oligomer; and y is 1 or 2.

The subject of the present invention is also a lubricant composition comprising a completely synthetic, partially synthetic or mineral oil based composition including at least one polycarboxylic acid ester defined by Formula I.

DESCRIPTION OF PREFERRED EMBODIMENTS

According to one of the preferred embodiments of the invention, the radical X in general Formula I stands for an arylene radical having the following formulas:

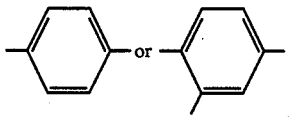

According to another preferred embodiment of the invention, the radical X stands for a straight or branched chain alkylene radical having the formula:

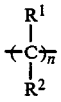

wherein $R^1$ and $R^2$ are, independently from one another, hydrogen or $C_1$–$C_5$ alkyl, and n is from 2 to 12; for example, for a $-(CH_2)_n$ radical ($R^1=R^2=H$).

According to another preferred embodiment, the radical R in general Formula I is a 9, 13 or 17 carbon atom radical afforded by the oxidation of an n-butene-oligomer. It is preferred that the radical R in general Formula I originates from the oxidation of a predominantly linear oligometric n-butene-oligomere, having a degree of oligomerization of from 2 to 4.

Most preferred as the polycarboxylic acid esters of Formula I are phthalic acid ester or adipic acid ester with $C_9$- and/or $C_{13}$-oxo-alcohols.

The lubricant compositions of the present invention contain at least one compound having the Formula I as defined above. Such lubricant compositions can, and typically will, contain other components conventionally incorporated with lubricating base oils. These lubricating base oils include completely synthetic lubricating oils, for example, poly-alpha-olefines, partially synthetic lubricating oils (semi-synthetic), mineral oil, or blends of said base oils. Other components conventionally incorporated in the base oils include, but are not limited to, one or more of: oxidation inhibitors, viscosity index improvers, pour point depressants, detergents and dispersants, extreme-pressure agents, friction modifiers, antifoam agents, demulsifiers, corrosion inhibitors, emulsifiers and emulsifying aids, dyestuffs, deblooming agents, fluorescent additives and the like. Generally, such additives are added to the base oils in amounts of from about 0.01 to about 5.0 percent by weight each based upon the total weight of the composition and will constitute from about 5.0 percent to about 25.0 percent by weight, based upon the total weight of the lubricant composition.

The polycarboxylic acid esters of Formula I can be employed individually or in mixtures with one another. These esters can be used alone or in mixtures with one another as the base oil in lubricating or as an additive in admixture with completely synthetic, partially synthetic, or mimeral oil base oils. When used as an additive, the esters of the present invention are present at from about 1 to about 30 percent by weight of the composition.

The polycarboxylic acid esters having Formula I preferably have nonyl and tridecyl radicals as mono alcohol components.

The alcohols R—OH (nonyl- and/or tridecyl alcohol) used in the esterification, are isomeric mixtures as they result from the oxo synthesis of the corresponding butene-oligomeres, namely octene and dodecene (butene-dimer and/or butene-trimer).

The intended use of the polycarboxylic acid esters having general Formula I is in lubricants. These can be for example: lubricating materials (lubricating oils) for the motors and transmissions of motor vehicles, compressor oils, hydraulic fluids, insulating liquids for electrical equipment, electrical contact oils, grease, chain grease, heat transfer liquids, vacuum pump oils, synthetic fiber lubricating materials, instrument oils, rust protective oils and milling oils. It is believed the present invention is useful in all applications in lubricating where a lubricant is necessary or desirable for lubricating contacting surfaces.

The polycarboxylic acid esters of the present invention compared to known esters exhibits a clearly improved temperature-viscosity behavior, expressed by a clearly higher viscosity index. A major prerequisite of lubricating oils is their viscosity at low temperatures, for example, at from 0° to −30° C., as required for lubricants in the lubricating oil specifications according to SAE J 300 (April 1984). The methods cited in DIN 51 377 (ASTM, D 26-06) serve as a method of measurement for the low temperature viscosity. The results from the viscosity measurements for the esters of the present invention evidence significant product application advantages over the known esters.

Furthermore, the esters of the present invention have a higher flash point than esters which are prepared from the known oxo-alcohols.

The esters of the present invention are more chemically uniform than, for example, esters from oxo-alcohols based on known propylenetetramers such as isodeodecene because of better distillation separation of the individual butene-oligomers; that is, separating a butene dimer from a butene trimer and/or a butene tetramer.

The esters of the present invention exhibit decreased evaporation losses (DIN 51 581) than the known esters. The evaporation loss measured according to DIN 51 581, is, along with the other product application data, a quality criteria for use as lubricating components.

Olefin oligomers suitable for oxo reactions are prepared according to conventional processes. Thus, one can obtain, for example, n-butene-dimers and/or n-butene-trimers following the disclosures in EP A 143 703, EP A 012 685, EP A 00 24 971 and DE A 31 17 864.

In the present case an industrial mixture of $C_4$-hydrocarbons (Raffinate-II containing from 60 to 80% of n-butenes) is catalytically oligomerized. The yield can be controlled depending on the processing conditions. One obtains a butene-oligomer, which contains from about 60 to about 90 percent of butene-dimer (octene), from about 10 to about 30 percent of butene-trimer (dodecene) and a corresponding remainder of $C_{12+}$-oligomers. Through distillation separation of the crude oligomer, one obtains the following oligometric fractions, which are suited for preparing oxo-alcohols for esterification into the esters of Formula I.

The first fraction boils at from 118° to 122° C. (the octene fraction).

The second fraction begins boiling at from about 200° to 220° C. (the dodecene fraction).

Residue begins boiling at over 230° C.

Analytical investigation of the oligomers shows the octene fraction is composed of the following:

55 to 60% methylheptenes;

5 to 7% n-octene; and the

Remainder is dimethylhexenes.

The present invention is further illustrated by the following examples. Examples 1, 3 and 5 are esters of the present invention and Examples 2, 4 and 6 are known esters prepared for purposes of comparison. All of the Examples, including technical data obtained on the Examples, is set forth below in Table II.

TABLE II

| | Characterization | | Lubricating Technical Data | | | | | | |
|---|---|---|---|---|---|---|---|---|---|
| | | | Viscosities (mPas) DIN 51 377[i] | | | Viscosity index | Pour point | Flash point | Evaporation loss[j] |
| Example | Product | Initial Olefine | −20° C. | −25° C. | +100° C. | (VI) | (°C.) | (°C.) | (%) |
| 1 | (a) | (d) | 900 | 1400 | 5.19 | 152 | −63 | 262 | 4 |
| 2 | (a) | (e) | 1300 | 2300 | 5.24 | 135 | −57 | 325 | 5 |
| 3 | (b) | (f) | <300 | 300 | 3.01 | 141 | −79 | 222 | 15 |
| 4 | (c) | (g) | 300 | 600 | 3.57 | 130 | −66 | 221 | 15 |

TABLE II-continued

| Example | Characterization: Product | Characterization: Initial Olefine | Lubricating Technical Data: Viscosities (mPas) DIN 51 377[l] −20° C. | −25° C. | +100° C. | Viscosity index (VI) | Pour point (°C.) | Flash point (°C.) | Evaporation loss[j] (%) |
|---|---|---|---|---|---|---|---|---|---|
| 5 | (k) | (d) | 9800 | — | 7.81 | 60 | −37 | 265 | 2.5 |
| 6 | (k) | (e) | 14700 | — | 8.22 | 75 | −32 | 260 | 3.0 |

[a]di-isotridecyl adipate
[b]di-isononyl adipate
[c]di-isodecyl adipate
[d]trimer butene
[e]tetramer propylene
[f]dimer butene
[g]trimer propylene
[j]evaporation loss according to Noack, DIN 51 581
[k]di-isotridecyl phthalate
[l]the lower measuring limit of method DIN 51 377 lies at viscosities of 300 mPas From the above data it can be seen that in comparison to the known di-isodecyl adipate based on a trimer propylene, (Example 4), the di-isononyl adipate based on a dimer butene according to the present invention, (Example 3), demonstrates a comparable flash point and evaporation loss, although it has 2 less $CH_2$ groups. Beyond this, it possesses a clearly higher viscosity index and a significantly lower low temperature viscosity than the known di-isodecyl adipate.

The embodiments of the invention in which an exclusive privilege or property is claimed are defined as follows:

1. A lubricant composition base oil consisting essentially of at least one aliphatic or aromatic polycarboxylic acid ester having the general formula:

$$(RO-\overset{O}{\overset{\|}{C}})_y-X-\overset{O}{\overset{\|}{C}}-OR$$

wherein

X is a straight or branched chain alkylene radical having the formula:

$$-\underset{R^2}{\overset{R^1}{\underset{|}{\overset{|}{C}}}}\Big)_n$$

where $R^1$ and $R^2$ are, independently, hydrogen or $C_1$–$C_5$ alkyl, and n is from 2 to 12; or an aryl radical having the formula:

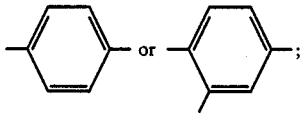

R is a 9 or 13 carbon atom radical afforded by the oxo reaction of predominately linear n-butene oligomer having a degree of oligomerization of 2 or 3; and y is 1 or 2.

2. An ester according to claim 1 wherein X is

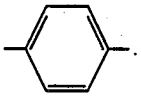

3. An ester according to claim 1 wherein X is a straight chain alkylene radical having 4 carbon atoms.

4. A lubricating oil composition comprising completely synthetic, partially synthetic or mineral oil as a base oil which includes in admixture at least one of an aliphatic or aromatic polycarboxylic acid ester having the formula:

$$(RO-\overset{O}{\overset{\|}{C}})_y-X-\overset{O}{\overset{\|}{C}}OR$$

wherein

X is a straight or branched chain alkylene radical having the formula:

$$-\underset{R^2}{\overset{R^1}{\underset{|}{\overset{|}{C}}}}\Big)_n$$

where $r^1$ and $R^2$ are, independently, hydrogen or $C_1$–$C_5$ alkyl, and n is from 2 to 12; or an aryl radical having the formula

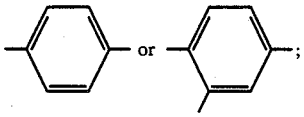

R is a 9 or 13 carbon atom radical afforded by the oxo reaction of predominately linear n-butene oligomer having a degree of oligomerization of 2 or 3; and y is 1 or 2.

5. A composition according to claim 4 where X in said ester is

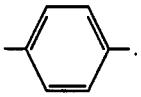

6. A composition according to claim 4 where X in said ester is a straight chain alkylene radical having 4 carbon atoms.

* * * * *